US005964286A

United States Patent [19]

Cuppen

[11] Patent Number: 5,964,286

[45] Date of Patent: Oct. 12, 1999

[54] TUBING ROTATOR

[75] Inventor: Nolan W. Cuppen, Calgary, Canada

[73] Assignee: Rotating Production Systems (Canada) Inc., Calgary, Canada

[21] Appl. No.: 09/013,928

[22] Filed: Jan. 27, 1998

[51] Int. Cl.[6] ..... E21B 33/04

[52] U.S. Cl. ..... 166/78.1; 166/75.14

[58] Field of Search ..... 166/78.1, 75.14, 166/84.3, 96.1, 117.6, 330

[56] References Cited

U.S. PATENT DOCUMENTS

| | | | |
|---|---|---|---|
| 2,599,039 | 6/1952 | Baker | 166/78.1 |
| 2,630,181 | 3/1953 | Solum | 166/78.1 |
| 5,427,178 | 6/1995 | Bland . | |
| 5,429,188 | 7/1995 | Cameron . | |
| 5,465,788 | 11/1995 | Wright . | |
| 5,875,841 | 3/1999 | Wright et al. | 166/85.4 |

FOREIGN PATENT DOCUMENTS

| | | |
|---|---|---|
| 2108838 | 9/1995 | Canada . |
| 2112602 | 12/1995 | Canada . |

OTHER PUBLICATIONS

Rodec Tool Company Inc. "Rodec Auto–Turn Thubing Rotator", Aug., 1994.

Variperm Packers Technical Manual Model 'S' Rotating Sub 101–0450–00 Stream–Flo Wellhead Oct. 26, 1993.

Jani International Catalogue 1987–88, Model T Rotating Sub Product No. 20–124.

Toolmaster "Dizzy Dognut Tubing Rotator" Product No. 20–126 undated brochure.

*Primary Examiner*—Frank Tsay

*Attorney, Agent, or Firm*—Murray E. Thrift; Adrian D. Battison

[57] ABSTRACT

A tubing rotator and hanger is used in a wellhead of an oil well. The rotator has a rotator body including a flange and a sleeve projecting from the bottom end of the flange. The flange engages between the wellhead flange and the upper wellhead components, adding a very short height to the overall height of the wellhead. A mandrel extends through a bore in the rotator body and is supported in the body by a bearing supporting a load shoulder on the mandrel. A ring gear is keyed to the mandrel and is driven by a worm extending into a bore in the rotator body flange. In preferred embodiments, the load shoulder and ring gear can be removed from the mandrel, allowing the rotator body to be lifted off the mandrel and a BOP installed when necessary.

9 Claims, 3 Drawing Sheets

TUBING ROTATOR

FIELD OF THE INVENTION

The present invention relates to tubing rotators for mounting on a wellhead for hanging and rotating a tubing string in a well bore.

BACKGROUND

Tubing rotators are mounted on wellheads to allow the rotation of the production tubing. This distributes wear caused by contact with a rod string driving a down hole pump and extends the life of the tubing.

The present invention is concerned with an improved rotator for this purpose.

SUMMARY

According to the present invention there is provided a tubing rotator and hanger for a wellhead having a wellhead flange, said tubing rotator and hanger comprising:

a rotator body including a rotator flange mountable on a top side of the wellhead flange, a through bore and a counter bore at the top side of the rotator flange;

a mandrel extending through the bore in the rotator body;

a load shoulder on the mandrel in the counter bore;

bearing means in the counter bore supporting load shoulder on the rotator;

a gear set within the rotator body comprising a drive gear mounted on the rotator body, means for rotating the drive gear and a driven gear mounted on the mandrel and engaged with the drive gear for rotating the mandrel when driven by the drive gear.

This rotator can be manufactured with a very short height, for example, 4½ inches (11.5 cm) so that the rotator adds only that height to the overall item wellhead.

The rotator is a single unit that is mounted on the wellhead as an assembled piece. In preferred embodiments, the load shoulder is removable from the mandrel, so that the rotator body can be removed. This allows an operator to install a blow out prevent (BOP) when necessary, for example, in the event that the tubing becomes stuck.

BRIEF DESCRIPTION OF THE DRAWINGS

In the accompanying drawings, which illustrate an exemplary embodiment of the present invention.

DETAILED DESCRIPTION

Figure 1:
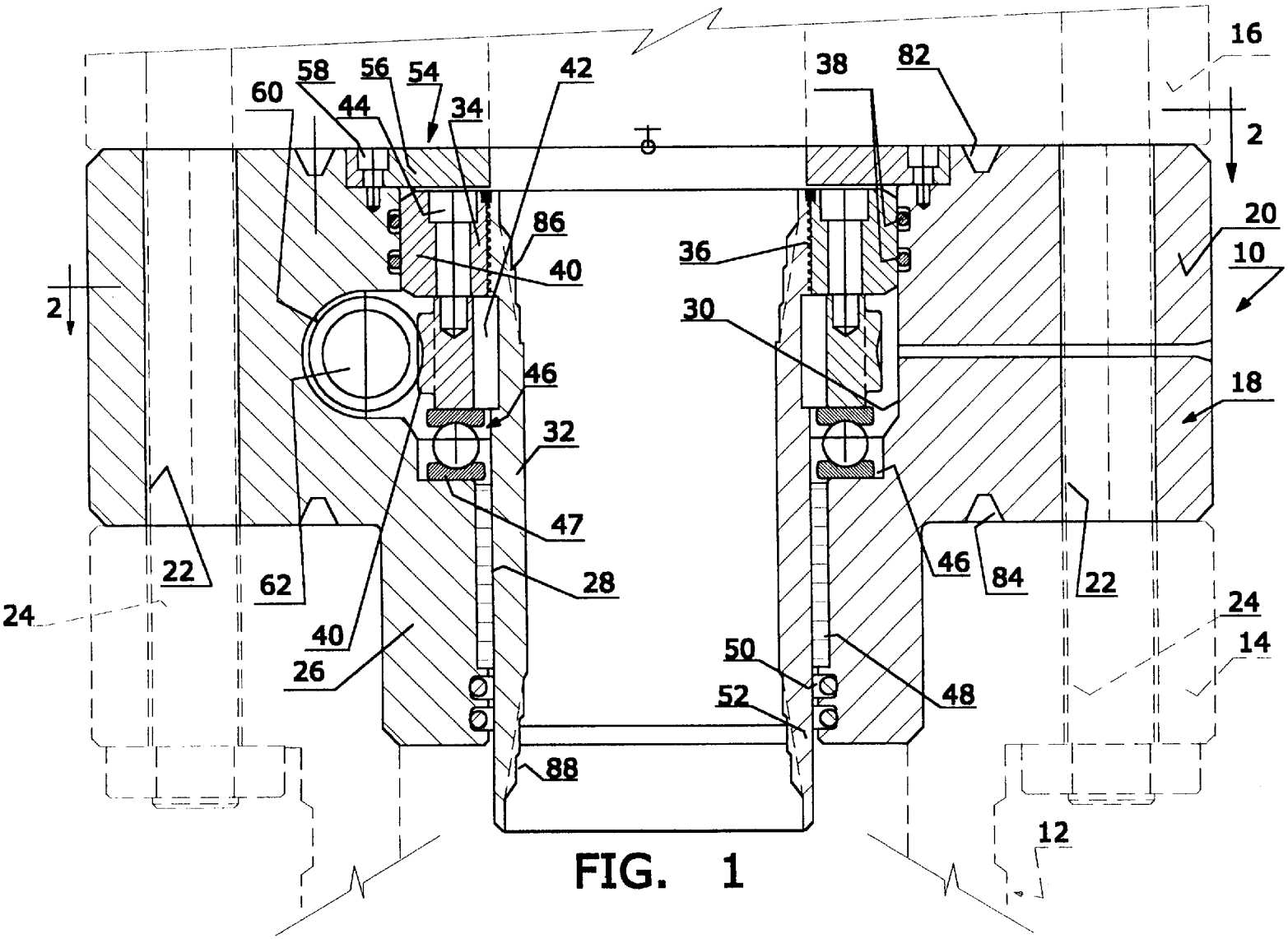
FIG. 1 is cross section of one embodiment of the present invention.
Figure 2:
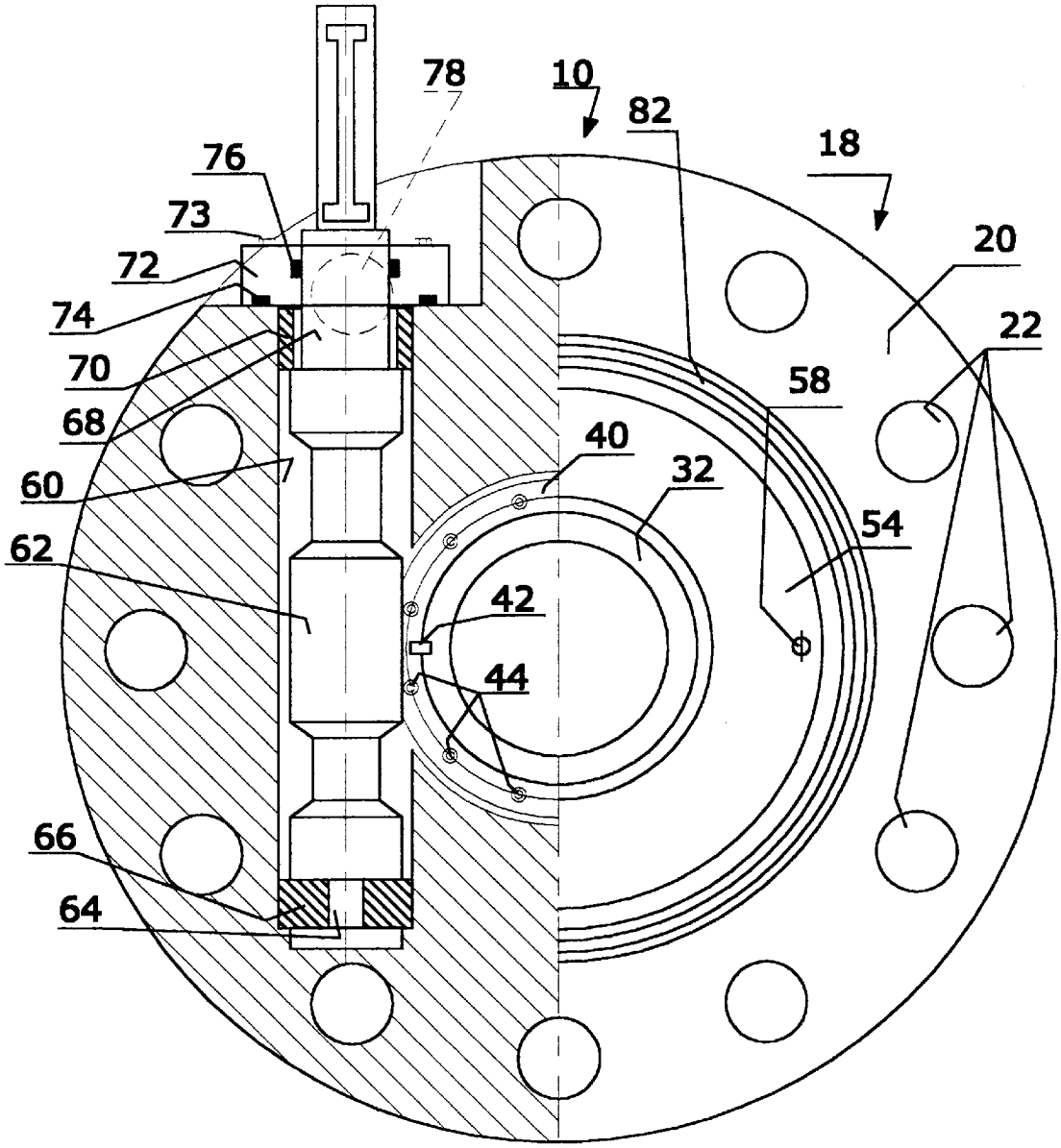
FIG. 2 is a cross section along line 2—2 of FIG. 1.

Referring to the accompanying drawings, there is illustrated a rotator 10 that mounts on a wellhead 12 to be supported by a wellhead flange 14. The upper wellhead components 16 mount on top of the rotator.

The rotator includes a rotator body 18, which includes a flange 20 of relatively low height. A ring of bolt holes 22 accommodates bolts 24 for mounting the rotator flange 20 on the wellhead flange 14 and the upper wellhead bolt 16 on the rotator flange.

The rotator body includes a sleeve 26 that projects from the bottom side of the flange 20. Through the body is bore 28 with a counter bore 30 at the upper end extending most of the way through the flange 20. A mandrel 32 extends through the bore. It has a peripheral load shoulder 34 at the upper end, secured to the mandrel by a thread 36. The load shoulder is positioned within the counter bore 30. O-ring seals 38 surround the load shoulder in the counter bore. Immediately below the load shoulder is a ring gear 40 coupled to the mandrel by a set of keys 42. The load shoulder and the ring gear are connected by a ring of cap screws 44 that are counter sunk into the top of the load shoulder.

The ring gear is supported on a bearing 46 that rests on the shoulder 47 between the counter bore 30 and the bore 28. A side load bearing 48 extends along the bore 28 within the sleeve 26 to support the mandrel against side loads. Two O-ring seals 50 and 52 below the bearing 48 seal the mandrel to the bore 28 below the bearing 48.

A retainer 54 is set into a recess 56 in the rotator flange 20 above the top of the mandrel 32 and the load shoulder 34. The rotator ring is held in place with a set of cap screws 58. This captures the mandrel and the load shoulder between the bearing 46 and the retainer 54.

Extending tangentially into the flange 20 at the level of the ring gear 40 is a bore 60 that accommodates a drive gear 62. The drive gear is a worm that meshes with the ring gear 40. The inner end of the drive gear 62 is pilot shaft 64 supported in a bearing 66 at the inner end of the bore 60.

At the outer end of the drive gear is a shoulder 68 that engages a bearing 70 supporting the worm at the outer end of the bore 60. The bearing is held in place by an end cap 72 around the end of the gear 62 that projects from the end and is fastened to it by appropriate bolts 73. Two O-rings 74 and 76 seal the drive gear to the end cap and the end cap to the flange 20 respectively.

Where the rotator body flange 20 is notched for the entry of the drive gear 62, the bolt holes 22 are replaced with two stud bores 78 above and below the drive gear bore 60. Instead of a through bolt 24, cap screws are used in the stud bores for securing the flange 20 to the wellhead flange 14 and the upper wellhead components 16.

Annular grooves 82 and 84 accommodate seals, sealing the top or bottom respectively of the rotator flange to the upper wellhead, and the wellhead flange respectively.

The mandrel is formed with two EUE Boxes 86 and 88 at the top and bottom respectively for connection to the tubing string.

In use of this rotator, the sleeve and the mandrel profile into the area of a wellhead where a tubing hanger would otherwise sit. This means that the height of the overall wellhead assembly, including the rotator is increased only by the height of the flange 20. As noted above, this can be quite small, for example 4½ inches (11.5 cm). The drive shaft for the rotator comes out of the side of the flange so that the rotator can usually be handled as a single assembly.

In the event that the tubing becomes stuck in the well, the mandrel can be disconnected from the rest of the assembly by installing a handling sub into the top thread 86 of the mandrel 32 to hold the weight of the tubing. The cap screws 58 are removed along with the retainer plate 54. The cap screws 44 are then removed and the load shoulder 34, the ring gear 40 and the keys 42 are removed from the mandrel. The rotator body 18 can then be lifted off the mandrel and a BOP installed. While particular embodiments of the invention have been described in the foregoing, it is to be understood that other embodiments are possible within the scope of the invention.

Figure 3:
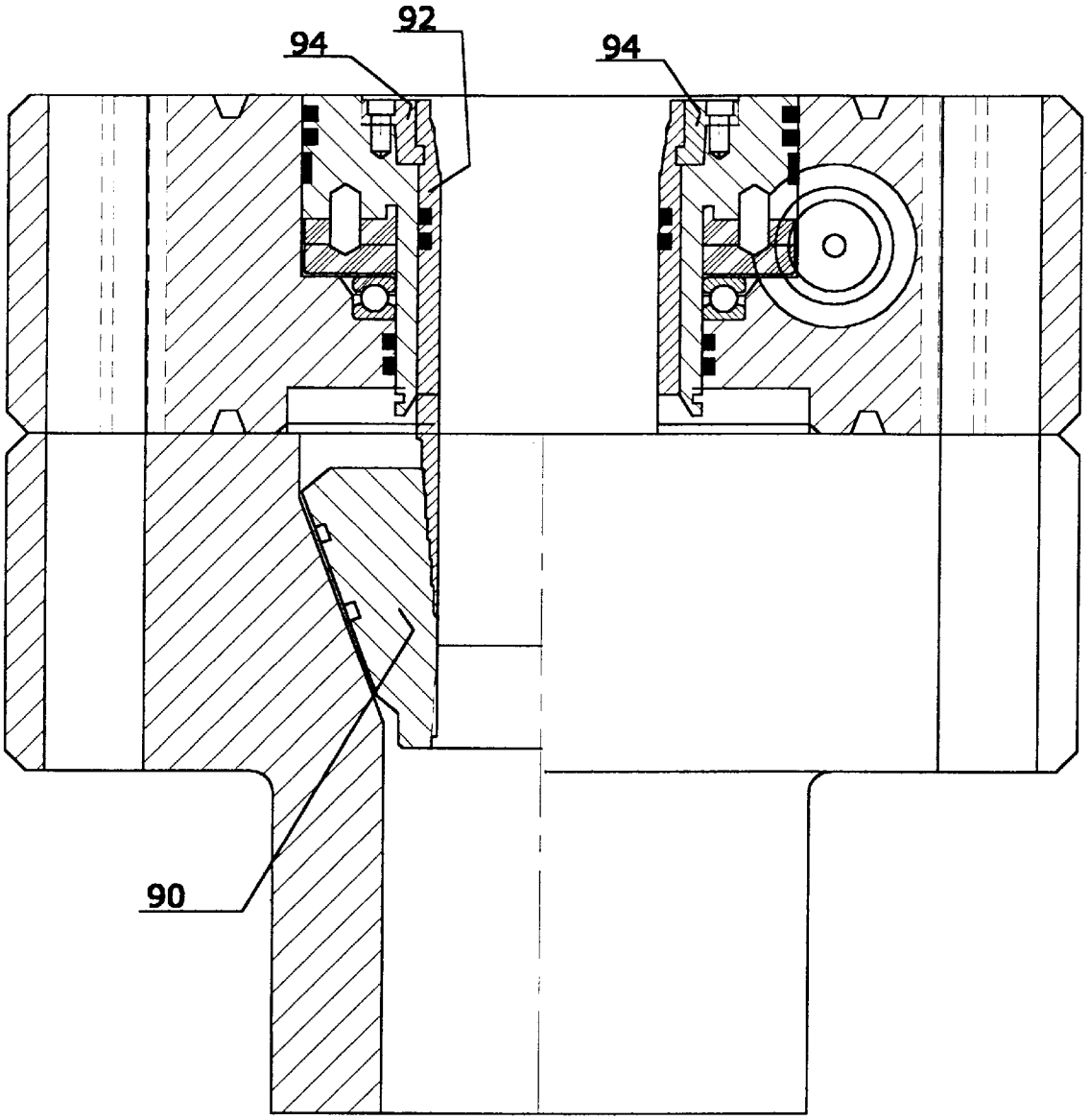
FIG. 3 is a cross section of an alternative embodiment of the invention.

In an alternative embodiment of the invention, illustrated in FIG. 3, the sleeve 26 is omitted. This allows the use of a dognut 90 into which the tubing string is screwed below the rotator for hanging the tubing string from the wellhead when the rotator is removed. The mandrel 92 is screwed into the dognut. A pair of split rings 94 engage the mandrel 92 with the load shoulder 94 to hang the tubing string, with the dognut unseated. Removal of the split rings seats the dognut and allows the rotator to be lifted off the mandrel.

In another, simpler embodiment of the invention, the load shoulder is integral with the mandrel. In such an embodiment, the rotator body cannot be lifted off the mandrel. In a further embodiment, the load shoulder is a split ring engaged between a shoulder on the mandrel and the top of the ring gear.

It is therefore to be understood that the invention is to be considered limited solely by the scope of the appended claims.

I claim:

1. A tubing rotator and hanger for a wellhead having a wellhead flange, said tubing rotator and hanger comprising:

a rotator body including a rotator flange mountable on a top side of the wellhead flange, a through bore and a counter bore at the top side of the rotator flange;

a mandrel extending through the bore in the rotator body;

a load shoulder on the mandrel in the counter bore;

bearing means in the counter bore supporting load shoulder on the rotator;

a gear set within the rotator body comprising a drive gear mounted on the rotator body, means for rotating the drive gear and a driven gear mounted on the mandrel and engaged with the drive gear for rotating the mandrel when driven by the drive gear.

2. A tubing rotator and hanger according to claim 1 including retainer means retaining the load shoulder in the counter bore.

3. A tubing rotator and housing according to claim 1 wherein the drive gear is a worm.

4. A rotator and hanger according to claim 3 wherein the driven gear is a ring gear secured to the mandrel below the load shoulder.

5. A rotator and hanger according to claim 1 wherein the load shoulder is selectively separable from the mandrel.

6. A rotator and hanger according to claim 1 wherein the mandrel comprises an internal thread at a bottom end thereof.

7. A rotator and hanger according to claim 1 wherein the mandrel comprises an internal thread at a top end thereof.

8. A rotator and hanger according to claim 1 wherein the load shoulder engages a top side of the driven gear and the bearing means support the driven gear in the counter bore.

9. A rotator and hanger according to claim 1 including a dognut secured to a bottom end of the mandrel.

* * * * *